US009404435B2

(12) United States Patent
Ranga et al.

(10) Patent No.: US 9,404,435 B2
(45) Date of Patent: Aug. 2, 2016

(54) METHODS AND SYSTEMS FOR ADJUSTING FUEL INJECTOR OPERATION

(71) Applicant: Ford Global Technologies, LLC, Dearborn, MI (US)

(72) Inventors: Adithya Pravarun Re Ranga, Canton, MI (US); Gopichandra Surnilla, West Bloomfield, MI (US); Ethan D. Sanborn, Saline, MI (US); Joseph Lyle Thomas, Kimball, MI (US); Mark Meinhart, South Lyon, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 93 days.

(21) Appl. No.: 14/556,752

(22) Filed: Dec. 1, 2014

(65) Prior Publication Data

US 2016/0153386 A1 Jun. 2, 2016

(51) Int. Cl.

| | |
|---|---|
| ***F02D 41/26*** | (2006.01) |
| ***F02D 41/30*** | (2006.01) |
| ***F02D 41/24*** | (2006.01) |
| ***F02D 41/38*** | (2006.01) |

(52) U.S. Cl.

CPC ..... *F02D 41/3094* (2013.01); *F02D 41/2406* (2013.01); *F02D 41/26* (2013.01); *F02D 41/3863* (2013.01)

(58) Field of Classification Search

CPC ..... F02D 41/26; F02D 41/14; F02D 41/1456; F02D 41/3029; F02D 41/247; F02D 41/3094; F02D 41/2406; F02D 41/3863; Y02T 10/42

See application file for complete search history.

(56) References Cited

U.S. PATENT DOCUMENTS

| | | | | |
|---|---|---|---|---|
| 5,448,977 | A | 9/1995 | Smith et al. | |
| 6,039,025 | A * | 3/2000 | Iwano | F02D 41/0065 123/399 |
| 6,244,241 | B1 * | 6/2001 | Mamiya | F02D 41/2461 123/295 |
| 6,401,703 | B1 * | 6/2002 | Mamiya | F02D 31/008 123/295 |
| 6,701,905 | B1 | 3/2004 | Gaskins | |
| 7,841,319 | B2 | 11/2010 | Thomas | |
| 8,239,119 | B2 | 8/2012 | Bagnasco et al. | |
| 8,290,687 | B2 | 10/2012 | Olbrich et al. | |
| 8,700,288 | B2 | 4/2014 | Huber et al. | |

OTHER PUBLICATIONS

Parotto, Marco et al., "Advanced GDI Injector Control with Extended Dynamic Range," SAE Technical Paper Series No. 2013-01-0258, published Apr. 8, 2013, 9 pages.

Ranga, Adithya Pravarun Re et al., "Methods and Systems for Learning Variability of a Direct Fuel Injector," U.S. Appl. No. 14/556,615, filed Dec. 1, 2014, 35 pages.

Ranga, Adithya Pravarun Re et al., "Methods and Systems for Adjusting a Direct Fuel Injector," U.S. Appl. No. 14/556,821, filed Dec. 1, 2014, 33 pages.

Ranga, Adithya Pravarun Re et al., "Methods and Systems for Adjusting a Direct Fuel Injector," U.S. Appl. No. 14/556,674, filed Dec. 1, 2014, 40 pages.

* cited by examiner

*Primary Examiner* — Hieu T Vo

(74) *Attorney, Agent, or Firm* — Julia Voutyras; Alleman Hall McCoy Russell & Tuttle LLP

(57) ABSTRACT

Systems and methods for improving fuel injection of an engine that includes a cylinder receiving fuel from two different fuel injectors is disclosed. In one example, a transfer function or gain of a direct fuel injector is adjusted in response to an exhaust lambda value and a fraction of fuel supplied to a cylinder during a cylinder cycle.

20 Claims, 4 Drawing Sheets

METHODS AND SYSTEMS FOR ADJUSTING FUEL INJECTOR OPERATION

FIELD

The present description relates to a system and methods for adjusting operation of a fuel injector for an internal combustion engine. The methods may be particularly useful for an engine that includes both port and direct fuel injectors.

BACKGROUND AND SUMMARY

Operation of a fuel injector may be described by a transfer function or gain that describes fuel injector flow or that describes an amount of fuel injected based on a fuel injector pulse width. Individual fuel injectors of a fuel system may be operated according to a single transfer function to provide a desired engine air-fuel ratio. However, there may be differences between fuel injectors that cause the amount of fuel injected to the engine to be different than is expected. For example, deposits may form at injector nozzles, thereby reducing fuel flow through the fuel injector. In other examples, one fuel injector may have slightly different nozzle holes that increase or decrease fuel injector flow as compared with fuel flow of a nominal fuel injector (e.g., a fuel injector that operates according to the fuel injector transfer function). Differences between expected fuel injector flow and actual fuel injector flow may lead to engine air-fuel errors. Further, if the fuel injector is operated in a ballistic operating region (e.g., a non-linear fuel flow region) where the fuel injector does not flow at a same rate as the fuel injector flows in a linear flow range, the fuel injector may exhibit additional fuel flow differences between its output and the fuel injector transfer function. For at least these reasons, it may be desirable to re-characterize fuel injector flow during a life cycle of an engine.

The inventors herein have recognized the above-mentioned disadvantages and have developed a method for fueling a cylinder, comprising: operating a fuel injector in a ballistic operating region supplying fuel to the cylinder; and adjusting a control parameter of the fuel injector in response to exhaust lambda and a fuel fraction provided to the cylinder by the fuel injector; and operating the fuel injector based on the adjusted control parameter.

By adjusting a fuel injector transfer function or gain based on exhaust lambda and a fuel fraction provided to a cylinder, it may be possible to provide the technical result of improve engine air-fuel control of a cylinder that includes two fuel injectors per cylinder without introducing significant fueling errors to an engine. For example, a first fuel injector may be commanded to provide a large fraction of fuel to a cylinder while a second fuel injector is commanded to provide a small fraction of fuel to a cylinder. Consequently, if the second fuel injector's transfer function or gain includes errors, the engine air-fuel ratio will only vary by a fraction of the error. Further, the fraction of error introduced by the second fuel injector's transfer function may be separated from the engine air-fuel ratio by dividing the engine exhaust lambda (e.g., air-fuel ratio divided by stoichiometric air-fuel ratio) by the fuel fraction provide by the second fuel injector. The second fuel injector's transfer function error may then be adapted or adjusted out of the second fuel injector's transfer function. In this way, fuel injector transfer function errors may be reduced even in ballistic operating ranges without causing large engine air-fuel ratio disturbances.

The present description may provide several advantages. In particular, the approach may reduce engine air-fuel errors.

Further, the approach may allow a fuel injector to be operated at pulse widths that were heretofore avoided because of non-linear fuel injector behavior. Further still, the approach may reduce engine emissions and improve catalyst efficiency.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
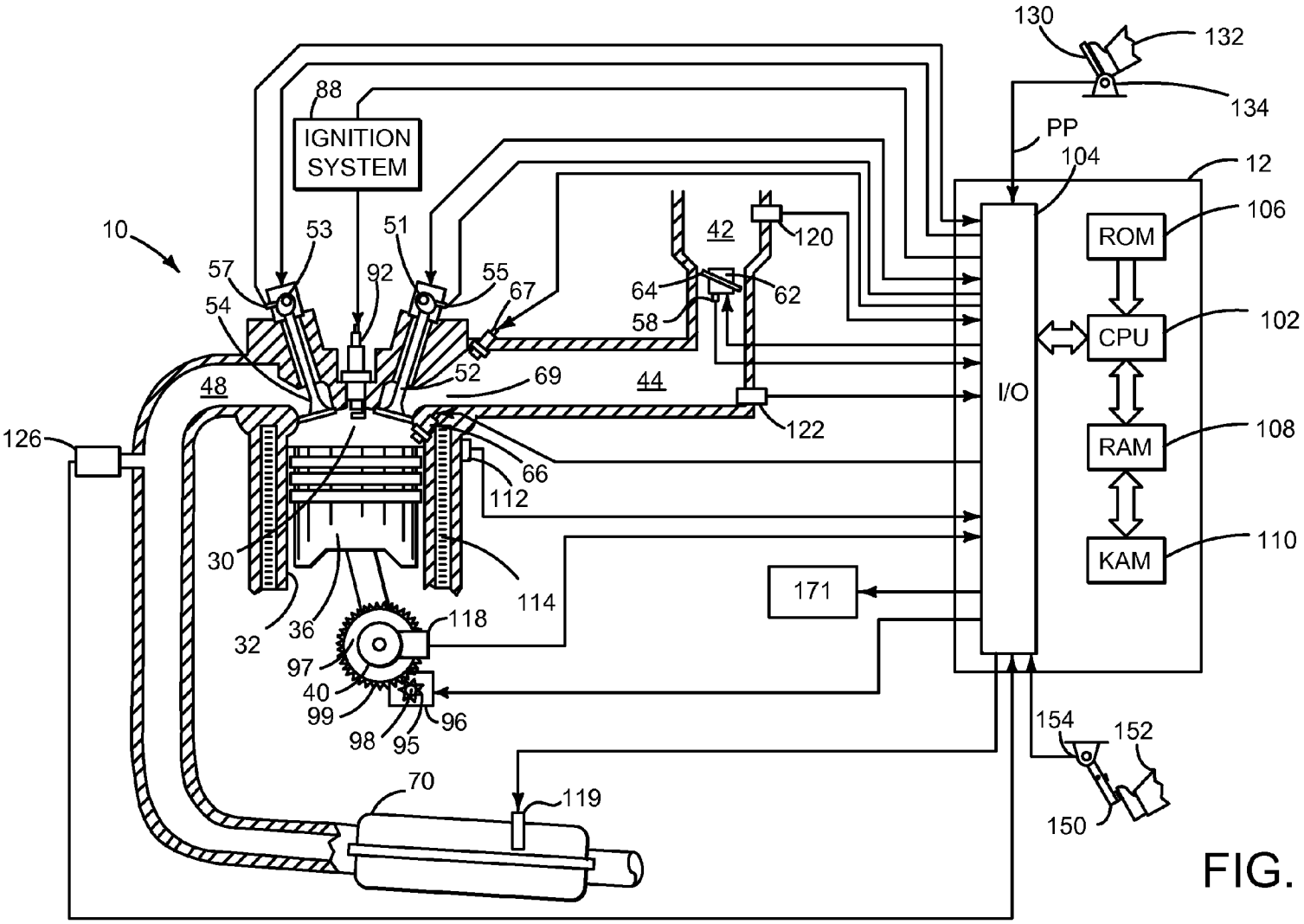
FIG. 1 is a schematic diagram of an engine.
Figure 3:
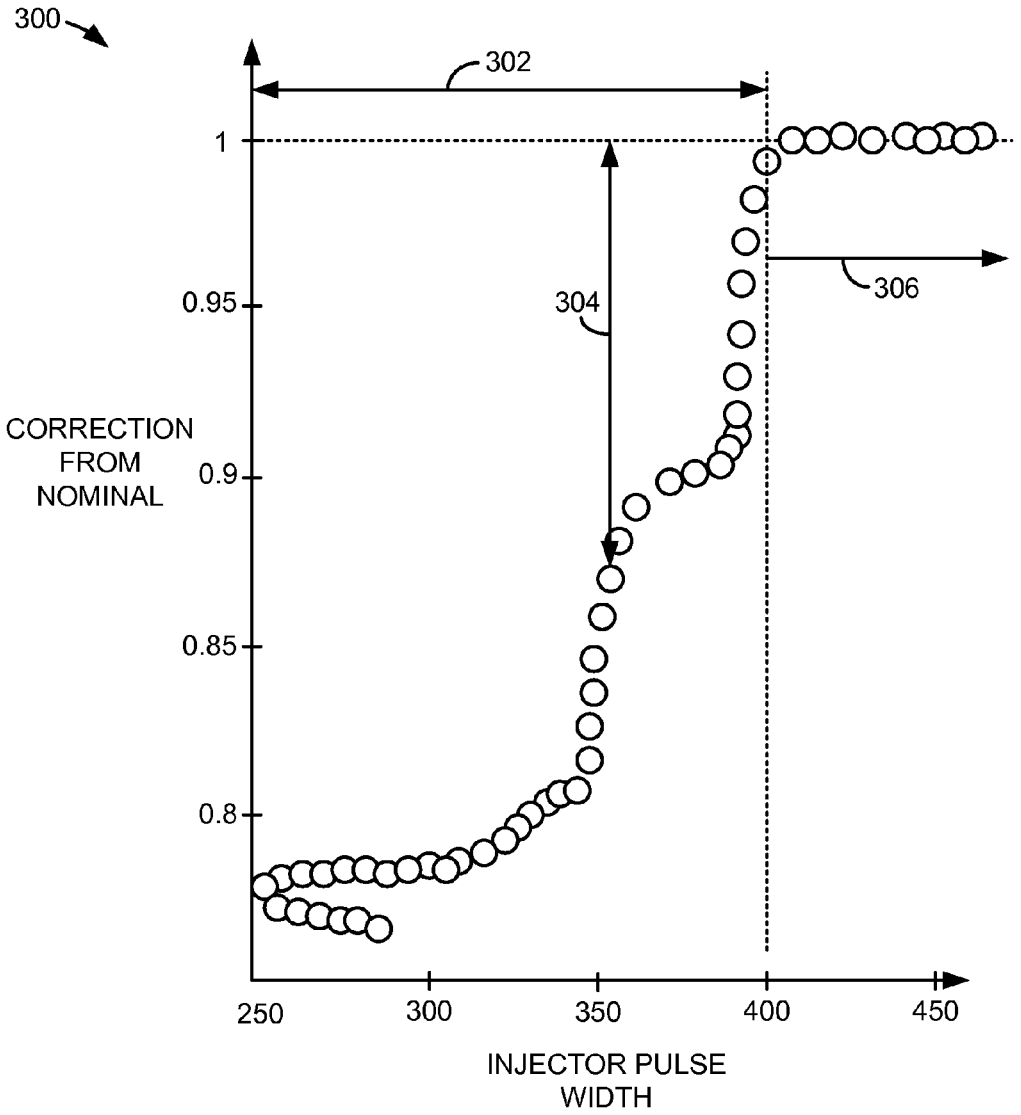
FIG. 3 shows a prophetic example plot of a fuel injector correction amount versus fuel injector pulse width for a fuel injector operating in a ballistic region.
Figure 4:
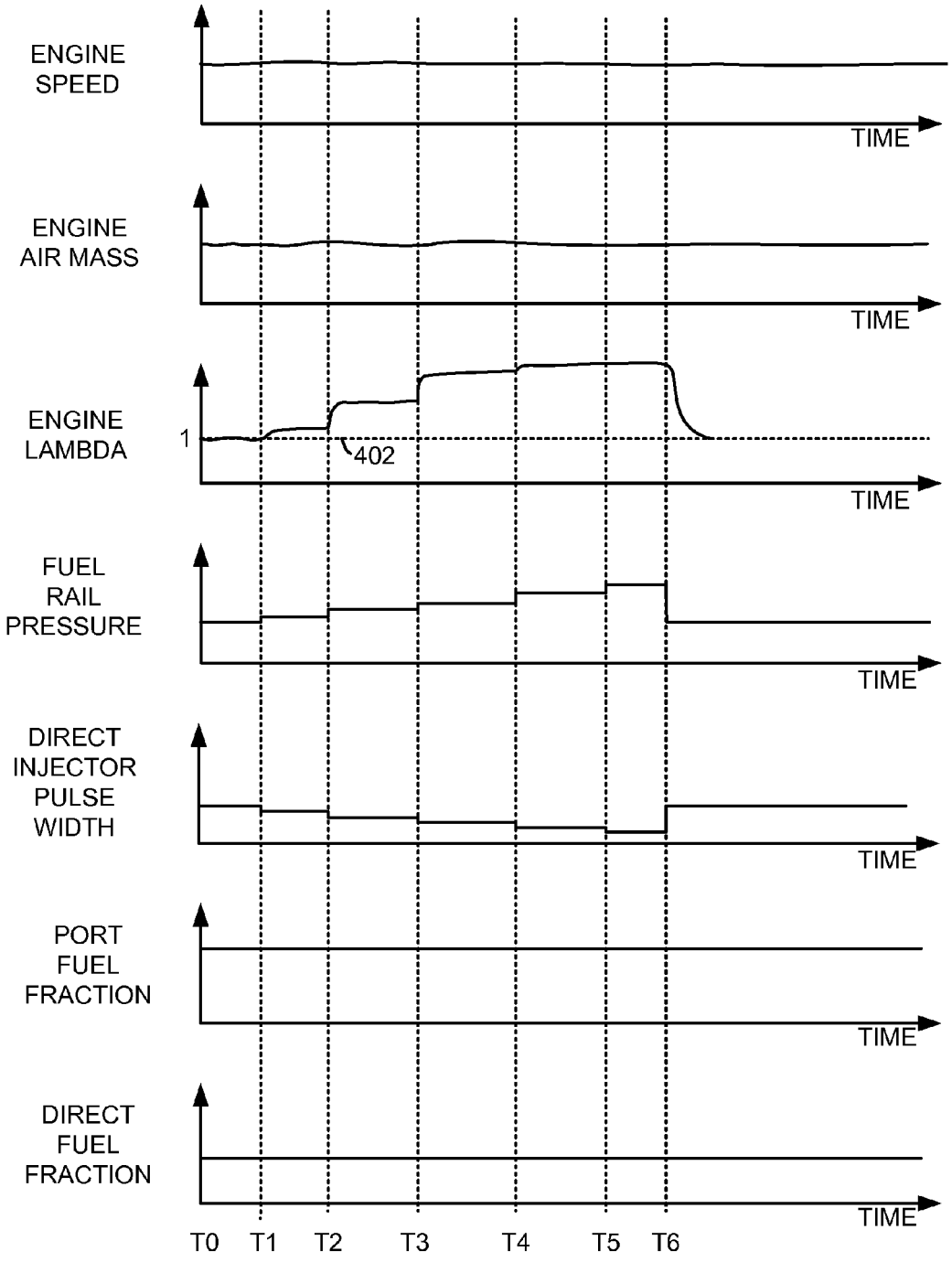
FIG. 4 shows a fuel injector operating sequence for adjusting fuel injector operation according to the method of FIG. 2.

The present description is related to correcting a fuel injector transfer function and operating fuel injectors based on the revised fuel injector transfer function. Fuel injectors may be incorporated into an engine as is shown in FIG. 1. The engine may be operated according to the method of FIG. 2 to update one or more fuel injector transfer functions. A fuel injector transfer function may be revised in a ballistic region of fuel injector operation where fuel injector flow may be non-linear as shown in FIG. 3. An engine may be operated as shown in the sequence of FIG. 4 according to the method of FIG. 2 to revise a fuel injector transfer function.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Direct fuel injector 66 is shown positioned to inject fuel directly into cylinder 30, which is known to those skilled in the art as direct injection. Port fuel injector 67, injects fuel to intake port 69, which is known to those skilled in the art as port injection. Fuel injector 66 delivers liquid fuel in proportion to a voltage pulse width or fuel injector pulse width of a signal from controller 12. Likewise, fuel injector 67 delivers liquid fuel in proportion to a voltage pulse width or fuel injector pulse width from controller 12. Fuel is delivered to fuel injectors 66 and 67 by a fuel system (not shown) including a fuel tank, fuel pump, and fuel rail (not shown). Fuel is supplied to direct fuel injector 66 at a higher pressure than fuel is supplied to port fuel injector 67. In addition, intake manifold 44 is shown communicating with optional electronic throttle 62 which adjusts a position of throttle plate 64 to control air flow from air intake 42 to intake manifold 44. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a position sensor 154 coupled to brake pedal 150 for sensing force applied by foot 152, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine with multiple fuel injectors. Further, controller 12 may communicate conditions such as degradation of components to light, or alternatively, display panel 171.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Thus, the system of FIG. 1 provides for a system, comprising: an engine including a cylinder; a port fuel injector in fluidic communication with the cylinder; a direct fuel injector in fluidic communication with the cylinder; and a controller including executable instructions stored in non-transitory memory for commanding the engine to operate at a constant air-fuel ratio while supplying fuel to the cylinder via the port fuel injector and the direct fuel injector, additional instructions for increasing a fuel pressure supplied to the direct fuel injector while continuing to command the engine to operate at the constant air-fuel ratio, and additional instructions to operate the direct fuel injector in a ballistic mode via decreasing a fuel pulse width supplied to the direct fuel injector while continuing to command the engine to operate at the constant air-fuel ratio.

In some examples, the system further comprises additional instructions to operate the engine at a constant speed and air mass while commanding the engine to operate at the constant air-fuel ratio. The system further comprises additional instructions to adjust a transfer function or gain of the direct fuel injector. The system includes where the transfer function or gain is adjusted based on an exhaust lambda. The system includes where the transfer function or gain is adjusted further based on a fuel fraction provided to the cylinder via the direct fuel injector during a cylinder cycle. The system further comprises additional instructions to incrementally increase fuel pressure supplied to the direct fuel injector while the engine is commanded to operate at the constant air-fuel ratio.

Figure 2:
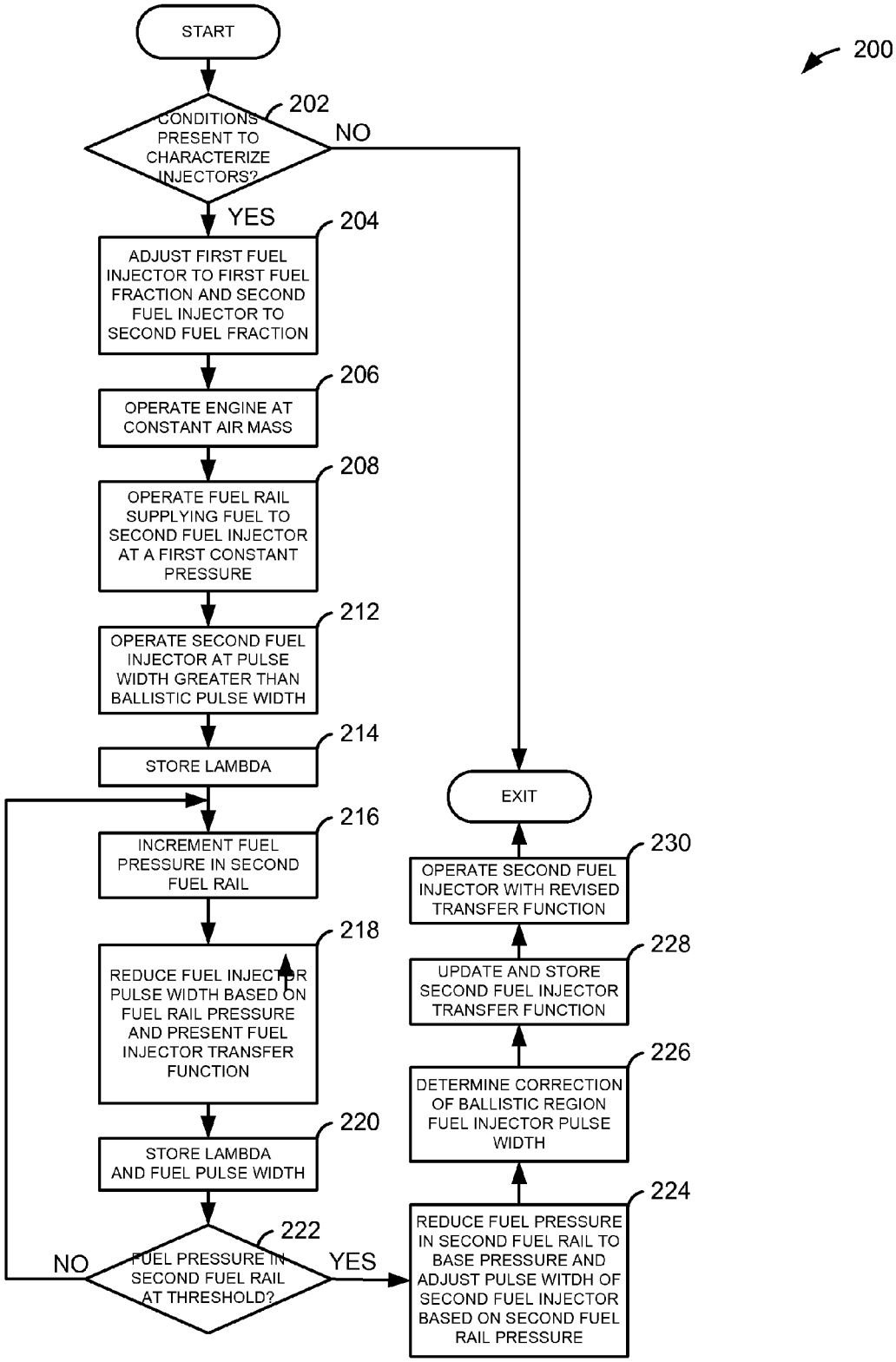
FIG. 2 shows a method for adjusting fuel injector operation.

Referring now to FIG. 2, a method for revising a fuel injector transfer function and operating an engine based on the revised transfer function is shown. The method of FIG. 2 may be included in the system of FIG. 1 as executable instructions stored in non-transitory memory. Further, the method of FIG. 2 may provide the operating sequence of FIG. 4.

At 202, method 200 judges if conditions are present for characterizing fuel injectors and adapting fuel injector operation. In one example, method 200 may judge that conditions are present for characterizing fuel injectors when an engine is idling with zero driver demand torque. In other examples, method 200 may judge that conditions are present for characterizing fuel injectors when the engine is operating at a constant engine speed and load, such as when a vehicle is in cruise control mode on a flat road. If method 200 judges that conditions are present for characterizing fuel injectors, the answer is yes and method 200 proceeds to 204.

At 204, method 200 adjusts a first fuel injector supplying fuel to a cylinder to deliver a first fuel fraction, and method 200 adjusts a second fuel injector supplying fuel to the cylinder a second fuel fraction. The first fuel injector may be a port fuel injector and the second fuel injector may be a direct fuel injector. A fuel fraction is a fraction of an amount of fuel delivered to the cylinder during a cylinder cycle. The fuel fraction of the first fuel injector and the fuel fraction of the second fuel injector add to a value of one. Thus, for example, the first fuel injector may be adjusted to a fuel fraction of 0.6 and the second fuel injector may be adjusted to a fuel fraction of 0.4. Consequently, if X grams of fuel are provided to the cylinder via the first and second fuel injectors, the first fuel injector supplies 0.6·X grams of fuel and the second fuel injector supplies 0.4·X grams of fuel.

In one example, where operation of the first fuel injector is not being characterized and where operation of the second fuel injector is being characterized, the first fuel injector is adjusted to a greater fuel fraction than the second fuel injector, 0.6 for example. Further, the fuel fraction of the second fuel injector may be adjusted such that the second fuel injector operates at fuel injector pulse width where fuel injector flow is linear, but close to where fuel injector flow is non-linear (e.g., near but not in a ballistic region of fuel injector operation).

In engines that have more than one cylinder, method 200 adjusts first injectors of all engine cylinders to deliver the first fuel fraction and adjust second fuel injectors of all engine cylinders to deliver the second fuel fraction. By operating the first fuel injectors of engine cylinders to provide a greater fuel fraction than the second injectors of engine cylinders, it may be possible to reduce the possibility of misfires and operating engine cylinders more rich or lean than is desired because fuel supplied by the first fuel injector remains constant large portion of fuel injected during the characterization of the second fuel injector. Method 200 proceeds to 206 after the fuel fractions of the first and second fuel injectors are selected.

At 206, method 200 operates the engine with a constant air mass. In one example, desired engine torque is determined from a driver demand torque, engine pumping losses, engine friction losses, and accessory losses. A desired amount of fuel to be injected is based on empirically determined fuel amounts that supply the desired engine torque at the present engine speed. The engine air mass is determined via multiplying the desired fuel amount by a desired constant air-fuel ratio (e.g., 14.64). The engine throttle position is adjusted to supply the engine air mass at the present engine speed. Thus, to operate the engine with a constant air mass, the engine is operated at a constant desired engine torque. Method 200 proceeds to 208 after the engine begins operating with a constant air mass.

At 208, method 200 operates the engine with a base pressure in the fuel rail supplying fuel to the second fuel injector. The base pressure may be based on empirically determined values stored in a table that is indexed by engine speed and load. The fuel pressure in the fuel rail supplying fuel to the second fuel injector is held constant at the base pressure. The second fuel rail may also supply fuel to second injectors of other engine cylinders. Method 200 proceeds to 210.

At 212, method 200 operates the engine with the second fuel injector being supplied a pulse width greater than a pulse width that operates the fuel injector in a ballistic or non-linear region of fuel flow. Further, the engine air-flow and amount of fuel supplied to engine cylinders during an engine cycle (e.g., two revolutions) is held constant as described previously. Additionally, for engines that have more than one cylinder, method 200 supplies fuel injector pulse widths greater than the pulse width that operates second fuel injectors in other engine cylinders in the ballistic or non-linear fuel flow region to the second fuel injectors of other engine cylinders. For example, if the second fuel injectors of other engine cylinders enter a ballistic mode when pulse widths of less than 400 micro-seconds are supplied to the second fuel injectors of the other engine cylinders, pulse widths of greater than 400 micro-seconds are supplied to second fuel injectors of the other engine cylinders. Method 200 proceeds to 214 after the engine begins to operate at the constant air mass and at the constant air-fuel ratio.

At 214, method 200 determines the lambda value the engine is operating at based on output from an exhaust gas oxygen sensor. The lambda value is the engine's present air-fuel ratio divided by the stoichiometric air fuel ratio (e.g., 14.3/14.64=0.977). The oxygen sensor outputs a voltage that is converted to engine air-fuel ratio via an oxygen sensor transfer function. The present value of lambda is stored to controller memory. Additionally, the second fuel injector's pulse width may also be stored to memory. Method 200 proceeds to 216 after the lambda value is stored to memory.

At 216, method 200 increments fuel pressure in the second fuel rail. By incrementing pressure in the second fuel rail, the second fuel injector flow rate will increase if the second fuel injector's pulse width were to be held constant because of the increased pressure drop across the second fuel injector. Fuel pressure supplied to the second fuel rail may be incrementally increased a plurality of times by looping back to 216 from 222. Likewise, fuel pressure supplied to second injectors of other engine cylinders is increased. Method 200 proceeds to 218 after fuel pressure in the second fuel rail is incremented.

At 218, method 200 reduces the fuel pulse width supplied to the second fuel injector in response to the increase in fuel pressure in the second fuel rail so that the engine may continue to operate at or near the constant commanded air-fuel ratio. In other words, controller 12 adjusts the fuel injector pulse width to compensate or adjust for the increase in fuel pressure which increases fuel injector flow so that engine air-fuel ratio continues to be commanded to a desired constant value. Further, reducing the fuel injector pulse width moves the fuel injector into the ballistic non-linear flow region so that the transfer function of the second fuel injector may be characterized in its ballistic operating region. The second fuel injector pulse width is reduced to a value that is expected to provide the desired constant engine air-fuel ratio based on the transfer function of the second fuel injector. Note that the transfer function of the second fuel injector may include a multiplier that adjusts the pulse width provided to the second fuel injector based on the pressure drop across the second fuel injector (e.g., pressure difference between the second fuel rail's fuel pressure and pressure in the cylinder fuel in which fuel is being injected). Additionally, the second fuel injector transfer function may relate fuel flow to fuel injector pulse width. Likewise, fuel pulse widths supplied to second injectors of other engine cylinders is decreased similarly. Method 200 proceeds to 220 after the fuel injector pulse width is adjusted to maintain the desired constant engine air-fuel ratio.

At 220, method 200 determines the lambda value the engine is operating at based on output from an exhaust gas oxygen sensor. The lambda value is the engine's present air-fuel ratio divided by the stoichiometric air fuel ratio. The oxygen sensor outputs a voltage that is converted to engine air-fuel ratio via an oxygen sensor transfer function. The present value of lambda is stored to controller memory. In addition, the second fuel injector's pulse width and pulse widths of other cylinder's second fuel injectors are stored to memory. Errors between the second fuel injector's pulse width for delivering the desired engine air-fuel ratio and the lambda value observed by the exhaust oxygen sensor are indications of errors in the second fuel injectors transfer function in the second fuel injector's ballistic operating region. Likewise, errors between the other cylinder's second fuel injector pulse widths for delivering the desired engine air-fuel ratio and the lambda value observed by the exhaust oxygen sensor are indications of errors in the other cylinder's second fuel injectors transfer functions in the second fuel injector's ballistic operating region. Method 200 proceeds to 222 after the lambda value is stored to memory.

At 222, method 200 judges if fuel pressure in the second fuel rail supplying fuel to the second fuel injector and other cylinder's second fuel injectors is greater than a threshold pressure. In one example, the threshold pressure is a pressure at which the second fuel injector's pulse width is well within a region where the second fuel injector operates in a ballistic or non-linear fuel flow range. For example, if the fuel injector is in a ballistic mode at fuel injection pulse widths less than 400 micro-seconds, the threshold pressure is a pressure that results in a pulse width being supplied to the second fuel injector at 200 micro-seconds or a pulse width where the second fuel injector is known not to open. If the answer is yes, method 200 proceeds to 224. Otherwise, method 200 returns to 216.

At 224, method 200 reduces fuel pressure in the second fuel rail to the base fuel pressure and increases the pulse width of the second fuel injector in response to the fuel pressure decrease in the second fuel rail so that the desired engine air-fuel ratio may be maintained. In particular, the fuel pressure in the second fuel rail is reduced to a level that causes the second fuel injector's pulse width to increase to a pulse width where the fuel injector operates in a linear flow region. Likewise, the fuel pressure in the second fuel rail is reduced to a level that causes the pulse widths of second fuel injectors of other cylinders to operate in a linear flow region. Method 200 proceeds to 226 after fuel pressure in the second fuel rail is reduced and the pulse width of the second fuel injector is increased.

At 226, method 200 method 200 determines corrections to nominal pulse widths of the second fuel injector at the pulse widths the fuel injector operated at in steps 214 to 220 during the time the fuel pressure in the second fuel rail was incremented. In one example, the fuel pulse width correction for each incremented fuel pressure is determined via the following equation:

$$\%\ \text{Correction_to_2}ndinjectorpw = \frac{\%\ \text{change_in_lambda_at_the_pw_from_nom}}{\text{fuel_frac_2nd_cyl}}$$

where %Correction_to_2ndinjectiorpw is the correction applied to the transfer function of the second fuel injector at a particular second fuel injector pulse width, %change_in_lambda_at_the_pw_from_nom is the percent change in the observed lambda value at the particular pulse width from the lambda value for a whole cylinder bank at the fuel pulse width applied when the second fuel injector is supplied fuel at the base pressure (e.g., lambda value at 214), and fuel_frac_2nd_cyl is the fuel fraction supplied by the second fuel injector when the particular second fuel injector pulse width is applied. Thus, if the lambda value at the particular second fuel injector pulse width changes by 5% and the fuel fraction provided by the second fuel injector is 0.4, the second fuel injectors transfer function value for the particular second fuel injector pulse width is adjusted by 0.05/.4=12.5 percent. Additionally, corrections to transfer functions of other cylinder's second fuel injectors may be performed in a same manner. However, in some examples, all the second fuel injectors of the engine will use a same transfer function. Therefore, a single transfer function for second fuel injectors of all engine cylinders may be revised. Method 200 performs similar adjustments to the second fuel injector's transfer function at all pulse widths the second fuel injector was operated at between steps 214 and 222.

At 228, the values stored in a table or function that represent the transfer function of the second fuel injector are revised by multiplying values stored in the transfer function by the corresponding injector correction determined at 226 and storing the result back into the second fuel injector transfer function. For example, if the second fuel injector transfer function describes the second fuel injector's flow at the 300 micro-second pulse width as Z, and the correction determined at 226 for the 300 micro-second pulse width is 10%, the revised value stored in the second fuel injector's transfer function is 0.1·Z. Revisions for when the second fuel injector is provided pulse widths other than 300 micro-seconds are also performed for each increment in fuel pressure performed at 216. Likewise, revisions for transfer functions of other cylinder's second fuel injectors may be performed similarly. In cases where a single transfer function describes operation of all the engine's cylinders second fuel injectors, the single transfer function is adjusted similarly. Method 200 stores the revised transfer function or functions in memory and proceeds to 230.

At 230, method 200 operates the engine via supplying fuel to engine cylinders based on the revised and stored second fuel injector transfer functions. For example, pulse widths are provided to each engine cylinder's second fuel injector, the pulse widths are based on a desired fuel mass to be delivered to a cylinder during a cycle of the cylinder and the transfer function that outputs a fuel injector pulse width according to a desired mass of fuel to be injected to the cylinder. Method 200 proceeds to exit after engine cylinders are operated in response to one or more revised second fuel injector transfer functions.

It should be noted that the first fuel injector and/or the first fuel injectors of other cylinders mentioned in the description of method 200 may be the port fuel injector shown in FIG. 1. Accordingly, the second fuel injector and/or the second fuel injectors of other cylinders mentioned in the description of method 200 may be direct fuel injectors shown in FIG. 1. Alternatively, the first fuel injector may be a direct fuel injector and the second fuel injector may be a port fuel injector.

Thus, the method of FIG. 2 provides for a method for fueling a cylinder, comprising: operating a fuel injector in a ballistic operating region supplying fuel to the cylinder; and adjusting a control parameter of the fuel injector in response to exhaust lambda and a fuel fraction less than one provided to the cylinder by the fuel injector; and operating the fuel injector based on the adjusted control parameter. The method includes where the ballistic operating region is an operating region where fuel flow through the fuel injector is non-linear. The method includes where the control parameter is a fuel injector gain or transfer function.

In one example, the method includes where the adjusted control parameter is stored to memory. The method includes where the fuel injector is a direct fuel injector. The method includes where the cylinder is in an engine, and where the engine is operated at a constant speed and air mass when the fuel injector is operated in the ballistic mode. The method includes where the fuel fraction is less than 0.5.

The method of FIG. 2 also provides for a method for fueling a cylinder, comprising: operating an engine at a constant speed and air mass; supplying a first fuel fraction to a cylinder of the engine via a first fuel injector while supplying a second fuel fraction to the cylinder via a second fuel injector; increasing a pressure of fuel supplied to the second fuel injector; decreasing a pulse width supplied to the second fuel injector to operate the second fuel injector in a ballistic region in response to increasing the pressure of fuel supplied to the second fuel injector; and adjusting a control parameter of the second fuel injector in response to exhaust lambda produced while the second fuel injector is operating in the ballistic region; and operating the second fuel injector based on the adjusted control parameter. The method includes where the first fuel injector is a port fuel injector, and where the second fuel injector is a direct fuel injector.

In some examples, the method includes where the control parameter is further adjusted based on a fraction of fuel supplied to the cylinder via the second fuel injector. The method includes where the second fuel injector's fuel flow is non-linear in the ballistic region. The method includes where the control parameter is a transfer function or gain. The method further comprises commanding the engine to operate at a constant air-fuel ratio while operating at the constant speed and air mass and while increasing the pressure of fuel supplied to the second fuel injector. The method includes where the first fuel fraction is greater than 0.5.

Referring now to FIG. 3, an example plot of a fuel injector correction amount versus fuel injector pulse width for a fuel injector operating in a non-linear or ballistic region is shown. The fuel injectors shown in FIG. 1 may operate similar to the way shown in FIG. 3.

The X axis represents fuel injector pulse width. A fuel injector pulse width may vary in duration from zero to tens of milliseconds. The Y axis represents a fuel flow correction from a nominal fuel injector flow rate. A nominal correction has a value of 1. When the fuel injector flow is less than nominal, the correction factor is a fraction of nominal (e.g., 0.8). As we apply this correction factor as (1/0.8). When the fuel injector flow is more than the nominal, the correction factor is more than 1 (e.g., 1.1). The circles represent individual data values for different fuel injector pulse widths.

In this example, the fuel injector begins to operate in a non-linear or ballistic range when fuel pulse widths are less than about 500 micro seconds (0.5 milli seconds). This range is indicated by leader 302. At higher or longer pulse widths, the fuel injector flow is a nominal amount as indicated by the value of one when fuel injector pulse widths are greater than 500 micro seconds (0.5 milli seconds) micro-seconds. This range is indicated by leader 306. When the fuel injector described by plot 300 is operated with a 450 micro-second pulse width, fuel injector flow is about 80 percent of nominal fuel injector flow rate as indicated by leader 304. This indicates that as we move in the low pulse width region, the amount of fueling decreases by a greater extent than what it is expected. Thus, the fuel flow rate of this particular fuel injector is decreased when the fuel injector is supplied a 450 micro-second injection pulse. So, if at 450 micro-seconds, there is 80% fueling compared to the nominal for the particular injector. This means when you request a fuel flow of 1 for the injector at 450 micro-seconds it actually delivers 0.8. Hence the correction factor is 0.8 and we need to request-1/correction factor (i.e., 1/0.8=1.25) times fuel to operate the injector at nominal flow of 1.

The correction factor is reduced further in response to fuel injector pulse widths that are less than 500 micro-seconds. At fuel injector pulse widths greater than 500 micro seconds, the correction from nominal is one (e.g., no correction). The fuel injector's nominal flow rate may be multiplied by the correction to provide the injector's fuel flow rate when a particular pulse width is applied to the fuel injector.

A plurality of correction values shown in FIG. 3 may be stored in a table or function as a transfer function for a fuel injector. The correction values may be adjusted or updated according to the method of FIG. 2. Thus, it may be possible to describe fuel injector flow in a fuel injector's ballistic operating range where the fuel injector may exhibit non-linear flow.

Referring now to FIG. 4, a fuel injector operating sequence for adjusting fuel injection according to the method of FIG. 2 is shown. Vertical markers T1-T6 represent times of interest during the sequence.

The first plot from the top of FIG. 4 is a plot of engine speed versus time. The Y axis represents engine speed and engine speed increases in the direction of the Y axis arrow. The X axis represents time and time increases from the left side of the plot to the right side of the plot.

The second plot from the top of FIG. 4 is a plot of engine air mass versus time. The Y axis represents engine air mass (e.g., air flow through the engine) and engine air mass increases in the direction of the Y axis arrow. The X axis represents time and time increases from the left side of the plot to the right side of the plot.

The third plot from the top of FIG. 4 is a plot of engine lambda versus time. The Y axis represents engine lambda and engine lambda increases in the direction of the Y axis arrow. The X axis represents time and time increases from the left side of the plot to the right side of the plot. Horizontal line 402 represents an engine lambda value of one.

The fourth plot from the top of FIG. 4 is a plot of fuel pressure in a fuel rail supplying fuel to a direct fuel injector versus time. The Y axis represents fuel pressure in the fuel rail and fuel pressure increases in the direction of the Y axis arrow. The X axis represents time and time increases from the left side of the plot to the right side of the plot.

The fifth plot from the top of FIG. 4 is a plot of direct fuel injector pulse width versus time. The Y axis represents direct injector pulse width and direct injector pulse width increases in the direction of the Y axis arrow. The X axis represents time and time increases from the left side of the plot to the right side of the plot.

The sixth plot from the top of FIG. 4 is a plot of port fuel injection fuel fraction versus time. The Y axis represents the port fuel injection fuel fraction and the port fuel injection fuel fraction increases in the direction of the Y axis arrow. The X axis represents time and time increases from the left side of the plot to the right side of the plot.

The seventh plot from the top of FIG. 4 is a plot of direct fuel injector fuel fraction versus time. The Y axis represents the direct fuel injector fuel fraction and the direct fuel injector fuel fraction increases in the direction of the Y axis arrow. The X axis represents time and time increases from the left side of the plot to the right side of the plot.

At time T0, the engine is operating at a constant engine speed with a constant air mass. The engine lambda value is one (e.g., the desired lambda value) and the fuel rail pressure is at a base fuel pressure for operating the engine at the present engine speed and load. The base fuel pressure may be empirically determined and stored to a table in memory that may be indexed via engine speed and load. The direct fuel injector pulse width is at a lower middle level and the port injector fuel fraction is set to constant value that is greater than the direct injector fuel fraction.

At time T1, the engine speed and air mass remain at their respective constant values and the fuel pressure in the fuel rail supplying fuel to the direct fuel injector is increased in response to a request to characterize the direct fuel injector. The direct fuel injector pulse width is reduced in response to the higher pressure in the fuel rail supplying fuel to the direct fuel injector. The direct fuel injector pulse width is reduced in an effort to maintain a constant engine air-fuel ratio. The direct fuel injector pulse width enters a ballistic region where fuel injector flow is non-linear. The port and direct injector fuel fractions remain unchanged. The engine lambda value begins to increase, thereby indicating that the direct fuel injector transfer function is providing a fuel pulse to the direct fuel injector resulting in a leaner engine air-fuel ratio than desired. The engine lambda value and the direct fuel injector pulse width are stored to memory a short time after time T1 and before time T2.

At time T2, the engine speed and air mass continue to remain at their respective constant values and the fuel pressure in the fuel rail supplying fuel to the direct fuel injector is increased in response to pressure in the fuel rail not having reached a predetermined pressure. The direct fuel injector pulse width is reduced in response to the higher pressure in the fuel rail supplying fuel to the direct fuel injector. In this way, the fuel injector pulse width is adjusted to maintain the engine air-fuel ratio in the presence of higher fuel pressure. The port and direct injector fuel fractions remain unchanged. The engine lambda value increases even more indicating that the fuel injector pulse width is further into the ballistic region. The increased lambda value indicates that the direct fuel injector transfer function is providing a fuel pulse to the direct fuel injector resulting in a leaner air-fuel ratio than desired. The engine lambda value and the direct fuel injector pulse width are stored to memory a short time after time T2 and before time T3.

At time T3, the engine speed and air mass continue to remain at their respective constant values and the fuel pressure in the fuel rail supplying fuel to the direct fuel injector is increased in response to pressure in the fuel rail not having reached a predetermined pressure. The direct fuel injector pulse width is reduced even more in response to an increase in fuel pressure in the fuel rail supplying fuel to the direct fuel injector. Thus, the fuel pulse width is adjusted again to maintain the engine air-fuel ratio. The port and direct injector fuel fractions remain unchanged. The engine lambda value increases still more indicating that the fuel injector pulse width is still in the ballistic region. The increased lambda value indicates that the direct fuel injector transfer function is providing a fuel pulse to the direct fuel injector resulting in a leaner air-fuel ratio than desired. The engine lambda value and the direct fuel injector pulse width are stored to memory a short time after time T3 and before time T4.

At time T4, the engine speed and air mass continue to remain at their respective constant values and the fuel pressure in the fuel rail supplying fuel to the direct fuel injector is increased in response to pressure in the fuel rail not having reached a predetermined pressure. The direct fuel injector pulse width is reduced even more in response to an increase in fuel pressure in the fuel rail supplying fuel to the direct fuel injector. The port and direct injector fuel fractions remain unchanged. The engine lambda value increases again, but a smaller amount this time. The direct fuel injector pulse width is still in the ballistic region. The increased lambda value indicates that the direct fuel injector transfer function is still providing a fuel pulse to the direct fuel injector resulting in a leaner air-fuel ratio than desired. The engine lambda value and the direct fuel injector pulse width are stored to memory a short time after time T4 and before time T5.

At time T5, the engine speed and air mass continue to remain at their respective constant values and the fuel pressure in the fuel rail supplying fuel to the direct fuel injector is increased in response to pressure in the fuel rail not having reached a predetermined pressure. The direct fuel injector pulse width is reduced even more in response to an increase in fuel pressure in the fuel rail supplying fuel to the direct fuel injector. The port and direct injector fuel fractions remain unchanged. The engine lambda value remains at a same value as at time T4. The direct fuel injector pulse width is still in the ballistic region. The increased lambda value indicates that the direct fuel injector transfer function is still providing a fuel pulse to the direct fuel injector resulting in a leaner air-fuel ratio than desired. The engine lambda value and the direct fuel injector pulse width are stored to memory a short time after time T5 and before time T6.

At time T6, the engine speed and air mass continue to remain at their respective constant values and the fuel pressure in the fuel rail supplying fuel to the direct fuel injector is decreased in response to pressure in the fuel rail having reached a predetermined pressure. The direct fuel injector pulse width is increased in response to the increase in fuel pressure in the fuel rail supplying fuel to the direct fuel injector. The port and direct injector fuel fractions remain unchanged. The engine lambda value returns to a value of one. The direct fuel injector pulse width is increased to a linear region that is outside of the ballistic region. The engine lambda value and the direct fuel injector pulse width are stored to memory a short time after time T6.

After time T6, the direct fuel injector transfer function may be adjusted to improve the transfer functions characterization of direct fuel injector operation. In one example, the entries in the direct fuel injection transfer function may be adjusted by multiplying present values in the direct injector transfer function by a correction value that is based on the change in engine lambda from a nominal value divided by the direct fuel injector fuel fraction as described in the method of FIG. 2. The direct fuel injectors may be subsequently operated based on the revised transfer function.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A system, comprising:

an engine including a cylinder;

a port fuel injector in fluidic communication with the cylinder;

a direct fuel injector in fluidic communication with the cylinder; and a controller including executable instructions stored in non-transitory memory for commanding the engine to operate at a constant air-fuel ratio while supplying fuel to the cylinder via the port fuel injector and the direct fuel injector, additional instructions for increasing a fuel pressure supplied to the direct fuel injector while continuing to command the engine to operate at the constant air-fuel ratio, and additional instructions to operate the direct fuel injector in a ballistic mode via decreasing a fuel pulse width supplied to the direct fuel injector while continuing to command the engine to operate at the constant air-fuel ratio.

2. The system of claim 1, further comprising additional instructions to operate the engine at a constant speed and air mass while commanding the engine to operate at the constant air-fuel ratio.

3. The system of claim 1, further comprising additional instructions to adjust a transfer function or gain of the direct fuel injector.

4. The system of claim 3, where the transfer function or gain is adjusted based on an exhaust lambda.

5. The system of claim 4, where the transfer function or gain is adjusted further based on a fuel fraction provided to the cylinder via the direct fuel injector during a cylinder cycle.

6. The system of claim 1, further comprising additional instructions to incrementally increase fuel pressure supplied to the direct fuel injector while the engine is commanded to operate at the constant air-fuel ratio.

7. A method for fueling a cylinder, comprising:

operating a fuel injector in a ballistic operating region supplying fuel to the cylinder; and adjusting a control parameter of the fuel injector in response to exhaust lambda and a fuel fraction provided to the cylinder by the fuel injector; and operating the fuel injector based on the adjusted control parameter.

8. The method of claim 7, where the ballistic operating region is an operating region where fuel flow through the fuel injector is non-linear.

9. The method of claim 7, where the control parameter is a fuel injector gain or transfer function.

10. The method of claim 7, where the adjusted control parameter is stored to memory.

11. The method of claim 7, where the fuel injector is a direct fuel injector.

12. The method of claim 7, where the cylinder is in an engine, and where the engine is operated at a constant speed and air mass when the fuel injector is operated in the ballistic mode.

13. The method of claim 7, where the fuel fraction is less than 0.5.

14. A method for fueling a cylinder, comprising:

operating an engine at a constant speed and air mass;

supplying a first fuel fraction to a cylinder of the engine via a first fuel injector while supplying a second fuel fraction to the cylinder via a second fuel injector;

increasing a pressure of fuel supplied to the second fuel injector;

decreasing a pulse width supplied to the second fuel injector to operate the second fuel injector in a ballistic region in response to increasing the pressure of fuel supplied to the second fuel injector; and adjusting a control parameter of the second fuel injector in response to exhaust lambda produced while the second fuel injector is operating in the ballistic region; and operating the second fuel injector based on the adjusted control parameter.

15. The method of claim 14, where the first fuel injector is a port fuel injector, and where the second fuel injector is a direct fuel injector.

16. The method of claim 14, where the control parameter is further adjusted based on a fraction of fuel supplied to the cylinder via the second fuel injector.

17. The method of claim 16, where the second fuel injector's fuel flow is non-linear in the ballistic region.

18. The method of claim 17, where the control parameter is a transfer function or gain.

19. The method of claim 14, further comprising commanding the engine to operate at a constant air-fuel ratio while operating at the constant speed and air mass and while increasing the pressure of fuel supplied to the second fuel injector.

20. The method of claim 14, where the first fuel fraction is greater than 0.5.

* * * * *